US005542898A

United States Patent [19]

Wilkinson

[11] Patent Number: 5,542,898

[45] Date of Patent: Aug. 6, 1996

[54] MULTIFUNCTION EXERCISE AND AEROBIC BENCH

[76] Inventor: William T. Wilkinson, Severnside Farm, 300 Kyle Rd., Crownsville, Md. 21032-0572

[21] Appl. No.: 150,821

[22] Filed: Nov. 12, 1993

[51] Int. Cl.[6] ..... A63B 21/00

[52] U.S. Cl. ..... 482/142; 482/130; 482/120

[58] Field of Search ..... 5/622; 482/128, 482/62, 130, 142, 94, 907, 908, 123, 120; 606/237, 240, 241

[56] References Cited

U.S. PATENT DOCUMENTS

| | | | |
|---|---|---|---|
| 1,582,653 | 4/1926 | Alleyne | 5/662 |
| 1,840,170 | 5/1932 | Neils | 5/662 |
| 2,585,660 | 2/1952 | Kjos et al. | 5/662 |
| 4,182,511 | 1/1980 | Camp, Jr. . | |
| 4,198,044 | 4/1980 | Halappa . | |
| 4,403,773 | 9/1983 | Swann . | |
| 4,466,613 | 8/1984 | Reese . | |
| 4,598,908 | 7/1986 | Morgan | 482/94 |
| 4,634,127 | 1/1987 | Rockwell | 482/142 |
| 4,696,469 | 9/1987 | Elder | 482/142 |
| 4,715,296 | 12/1987 | Wilkinson . | |
| 4,832,336 | 5/1989 | Lahman . | |
| 4,838,547 | 6/1989 | Sterling | 482/128 |
| 4,856,775 | 8/1989 | Colledge | 482/142 |
| 5,042,801 | 8/1991 | Sterba et al. . | |
| 5,112,287 | 5/1992 | Brewer | 482/123 |
| 5,125,699 | 6/1992 | Fuller . | |
| 5,184,991 | 2/1993 | Brangi | 482/908 |

FOREIGN PATENT DOCUMENTS

| | | | |
|---|---|---|---|
| 8202832 | 9/1982 | WIPO | 5/662 |

*Primary Examiner*—Richard J. Apley
*Assistant Examiner*—Jerome Donnelly
*Attorney, Agent, or Firm*—Connolly & Hutz

[57] ABSTRACT

A multifunction exercise and aerobic bench includes an elongated support member having a head end and a foot end. Legs extend below each of the head end and foot ends to elevate the support member. Handles are secured to the support member at the head end and extend upwardly above the support member. The legs at the foot end are movably mounted so that the elevation of the foot end can be lower than the head end to selectively incline the support member. A bar is pivotally mounted at the foot end for moving in an arc.

19 Claims, 3 Drawing Sheets

MULTIFUNCTION EXERCISE AND AEROBIC BENCH

BACKGROUND OF THE INVENTION

Various types of exercise devices exist for developing different parts of the body. A particularly successful form of exercise device used in conjunction with aerobic programs is an adjustable step. Other devices are also known which may function to aid in exercises in addition to the aerobic exercises from adjustable steps. My U.S. Pat. No. 4,715,296, for example, discloses a utility bench which is in the form of a planar support platform having adjustable legs to vary the height of the platform. The utility bench could be used as an exercise bench or for other forms of exercise.

Three of the most difficult areas of the body to develop are the muscles of the lower back, abdomen and buttocks. It would be desirable if a single exercise and aerobic device could be provided which would lend itself to performing various exercise and aerobic techniques and particularly which could be used to develop the muscles of the lower back, abdomen and buttocks.

SUMMARY OF THE INVENTION

An object of this invention is to provide a multifunction exercise and aerobic bench which fulfills the above needs.

A further object of this invention is to provide such a bench that allows the user to do various exercises and develop the three difficult areas noted above.

In accordance with this invention the multifunction exercise and aerobic bench is in the form of an elongated support member having a head end and a foot end for supporting a user. At least one leg is mounted to each of the head ends and the foot ends and extends below the support member for elevating the support member. Handles are secured to and extend above the support member. The legs at the foot ends are movably mounted so that the foot end could be lowered below the head end to selectively incline the support member. A bar is pivotally mounted at the foot end in such a manner as to move in an arc.

In the preferred practice of the invention the handles are adjustably and detachably mounted. Additionally, the foot end bar is also adjustably mounted. An adjustable belt or strap may be attached to the bench to secure the legs of the user in various exercises. The bench may also include at least one elastic cord that hooks on the legs of the bench or to the ends of the bar to provide resistance in other exercises or the cord may be secured on to the bench and around the user's waist to provide resistance. The support member is preferably padded with a pad that may be detachable so that it functions as a cushion when used on the support member, but could also be used as a floor mat for other exercises.

DRAWINGS

DETAILED DESCRIPTION

Figures 1, 2, 3:
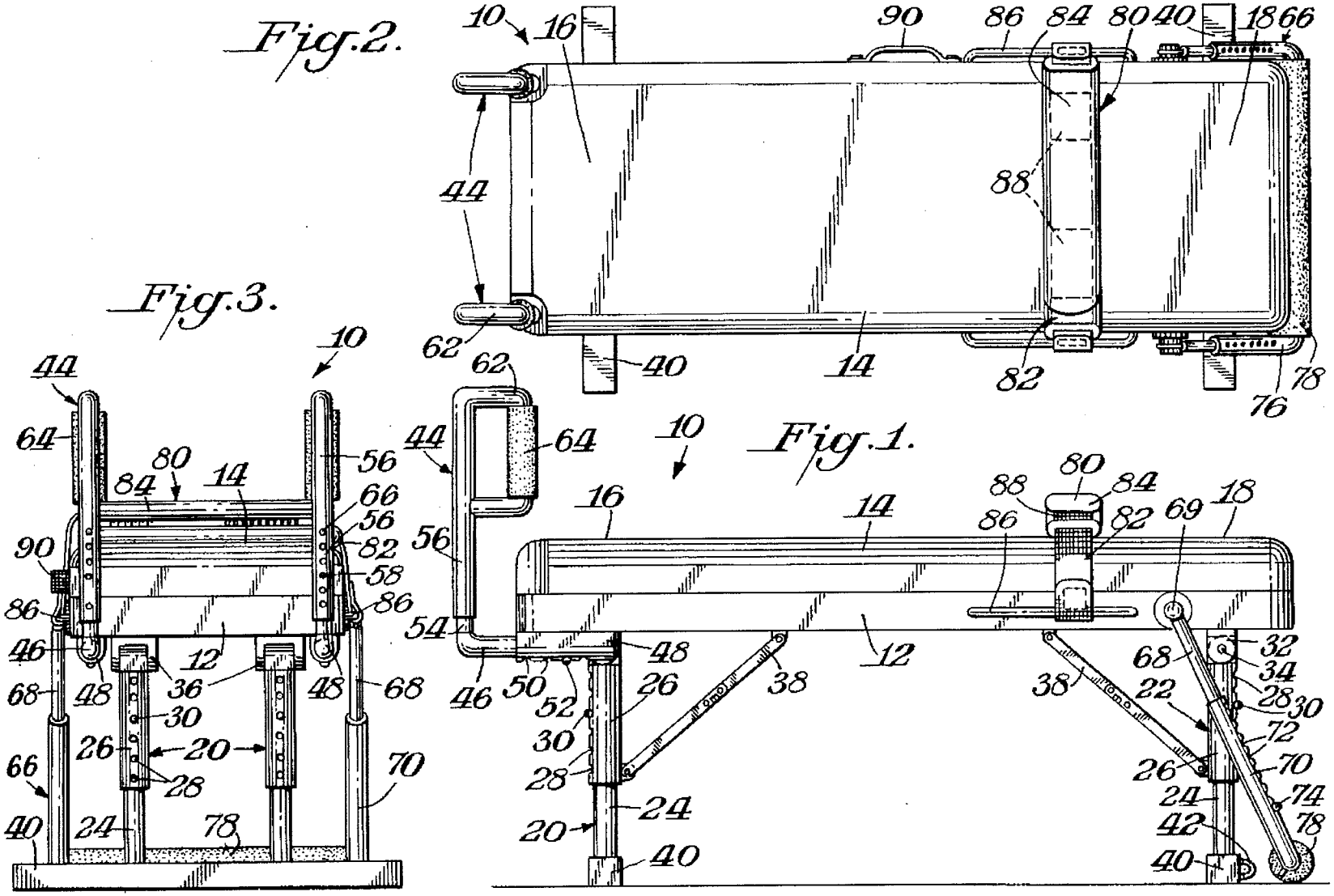
FIG. 1 is a side elevational view of a multifunction exercise and aerobic bench in accordance with this invention.
FIG. 2 is a top plan view of the bench shown in FIG. 1.
FIG. 3 is an end elevational view of the bench shown in FIGS. 1–2 taken of the head end.

The present invention relates to a multifunction exercise and aerobic bench. As shown in the drawings the bench 10 includes an elongated support member 12 which is preferably padded by being covered with a mat 14. Mat 14 is preferably a heavy pad of any suitable material which may be permanently attached to support member 12. In the preferred practice of the invention, however, mat 14 is detachably mounted in any suitable manner, such as by straps, clips, hook and loops, or any other fasteners. By being detachably mounted the mat not only acts as a cushion when the user exercises on support member 12, but also the mat can be removed from support member 12 and used as a floor mat for other exercises.

Figure 4:
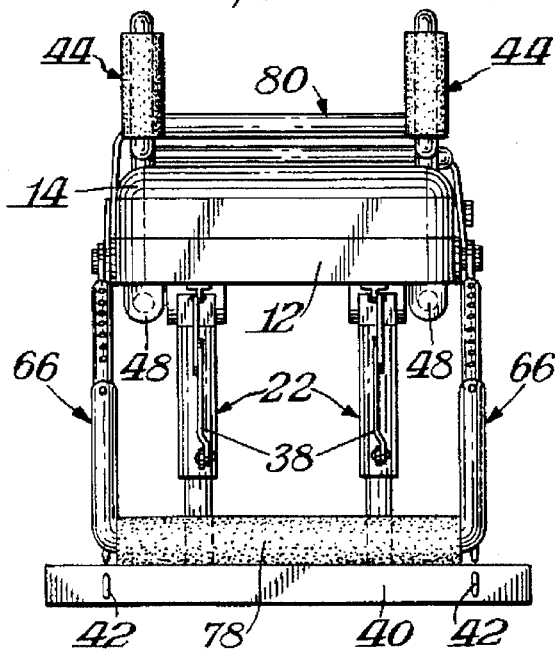
FIG. 4 is a end elevational view of the bench shown in FIGS. 1–3 taken of the foot end.

Support member 12 may be considered as having a head end 16 and a foot end 18. At least one leg and preferably two legs 20, 20 are connected to head end 16 and similarly at least one leg and preferably two legs 22, 22 are connected to foot end 18 of support member 12. Each of the legs 20, 22 is preferably adjustably mounted in height by any suitable means. In the illustrated embodiment the height adjustability is achieved by having each leg 20, 22 take the form of a pair of telescopic tubes comprising a smaller diameter lower tube 24 and a larger diameter upper tube 26 into which tube 24 telescopes. Outer upper tube 26 would have a plurality of vertically spaced holes 28 into which a spring biased pin 30 on inner tube 24 could be selectively positioned. (The invention could be practiced with a larger lower tube and smaller upper tube.) Each leg is pivotally mounted by having the upper member 26 secured to a bracket 32 with a pivot pin 34 extending through a yoke 36 at the upper end of outer tube 26. A hinged connecting member 38 of the type described in U.S. Pat. No. 4,715,296 preferably connects each leg to the underside of support member 12.

Where a single elongated leg is provided at each of the ends 16 and 18 of bench 10 the lower surface of the elongated leg would preferably have a non-skid material to prevent bench 10 from slipping. In the illustrated preferred embodiment a pair of legs 20, 20 or 22, 22 is provided at each end of the bench 10. Each pair of legs 20, 20 and 22, 22 is interconnected by an elongated foot 40 which is of sufficient length to provide stability to bench 10. As illustrated in FIGS. 2–4 each foot 40 extends outwardly beyond the perimeter of support member 12. If desired, the lower surface of foot 40 may also have a non-skid material. Further, one or both of the feet 40 may have a loop at spaced locations on foot 40 for fastening purposes as later described.

Figure 5:
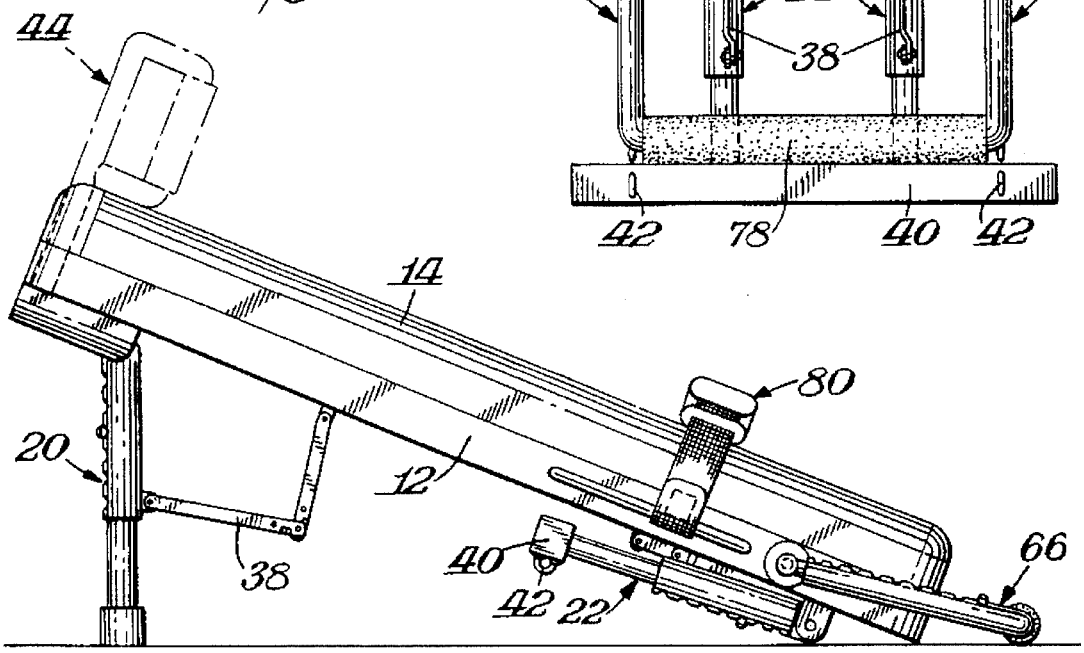
FIG. 5 is a side elevational view of the bench shown in FIGS. 1–4 in a different phase of operation.
Figure 6:
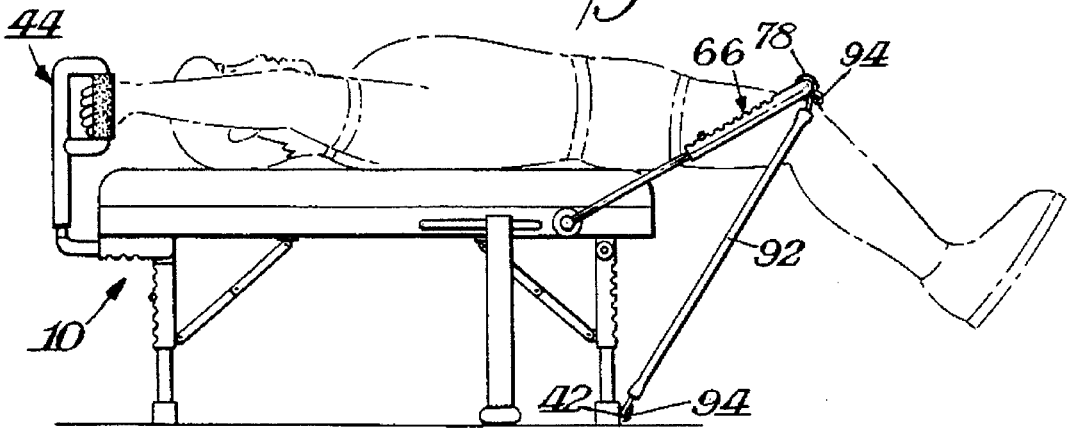
FIGS. 6–8 are side elevational views showing a user performing different exercises with the bench of FIGS. 1–5.

By having a hinged connecting member 38 it is possible to fold each leg back against the underside of support member 12. FIG. 5, for example, illustrates bench 10 with the rear legs 22 folded to a completely inactive position. This would create a slant board. As shown therein the connecting member 38 for the front members 20 are partially manipulated and the legs 20 may also be folded against the underside of support member 12 to provide a compact unit when it is desired to transport and/or store bench 10.

One of the features of bench 10 is the incorporation of handles 44. It is preferred that a handle be disposed generally at each of the opposite sides of head portion 16. In the preferred embodiment each handle is an individual member. The invention, however, may be practiced where the handles form the legs of a U or Y shaped member so that the legs are interconnected together. In the preferred practice of the invention as illustrated herein each handle 44 is detachably mounted to support member 12 by having a horizontal extension 46 inserted into a sleeve or bracket 48. Adjustability of each handle 44 is achieved in any suitable manner. In the preferred embodiment illustrated herein sleeve 48 includes a plurality of holes 50 for selectively receiving a spring pin 52 on horizontal leg or extension 46. Vertical adjustability of handle 44 is achieved by having a vertical member 54 extend upwardly from horizontal leg 46 and be telescoped into outer tubular member 56 which in turn has a plurality of holes 58 for selectively receiving a spring pin 60 on inner leg or member 54. The handle portion, itself, is formed by a U-shaped extension 62 which has a padded bight 64 for comfort of the user.

Although in the preferred practice of the invention handles 44 are detachably and adjustably mounted to support member 12 the invention may be practiced with the handles permanently mounted to support member 44 and either adjustable or fixed. By having the handles detachable, however, it is possible to remove the handles during periods of non-use and store the handles either separately from or in association with support member 12. The handles may, for example, be strapped to support member 12 by insertion through a later described strap or belt secured to support member 12.

A further feature of bench 10 is the inclusion of a bar 66 at the foot end 18 of bench 10. Bar 66 would be used for various leg exercises. Bar 66 may take any suitable form. In a preferred practice of the invention bar 66 is of U-shape having a pair of tubular members 68 pivotally connected by any suitable pivotal connection 69 to the side of bench 12. Tubular member 68 is telescopically inserted into outer tubular member 70 and is adjustably secured in any suitable manner, such as by the provision of holes 72 in outer tube 70 with a spring pin 74 of inner tube 68 locking inner tube 68 in its desired position in outer tube 70. The outer tubes are interconnected by a horizontal bight member 76 which is covered by padding 78 for comfort of the user. The illustrated form of mounting is such that bar 66 may rotate in an arc between the floor and the upper surface of mat 14. For most exercises it is preferred that bar 66 is mounted at the end of bench 10 opposite that of handles 44. It is to be understood, however that the invention may be practiced with the bar and handles mounted at the same end which may be either the head end or the foot end of bench 10.

Bar 66 could also be a portion of a U-shape such as an L-shape attached at one end to support member 12 with the offset portion corresponding to the bight of the U.

As also illustrated bench 10 includes a belt 80 which is made of individual strap members 82, 84. An end of each strap 82, 84 is connected to a respective side of support member 12 in any suitable manner. As illustrated a U-shaped bracket 86 is provided on each side of support member 12 so that the free end of its respective strap 82,84 may be looped around U-shaped bracket 86 and each free end may be secured to itself in any suitable manner such as by loop/hook fasteners. The opposite ends of each strap 82,84 may also be adjustably secured to each other in any suitable manner such as by hook/loop fasteners 88 (FIG. 1) so as to accommodate different users to permit the belt 80 to be wrapped around the bench (i.e. preferably to individual brackets 86) and secure the legs of the user in the performance of various exercises. Belt 80 could be a single strap looped around support member 12 with the free ends adjustably secured together as previously described.

As previously described strap 80 may also be used as a convenient member for holding detached elements such as handles 44 to support member 12 when bench 10 is in its transported and storage condition. When in this folded condition use may be made of a handle member 90 which could be a rigid handle or flexible strap at one side of support member 12 to permit the bench 10 to be carried.

Figure 7:
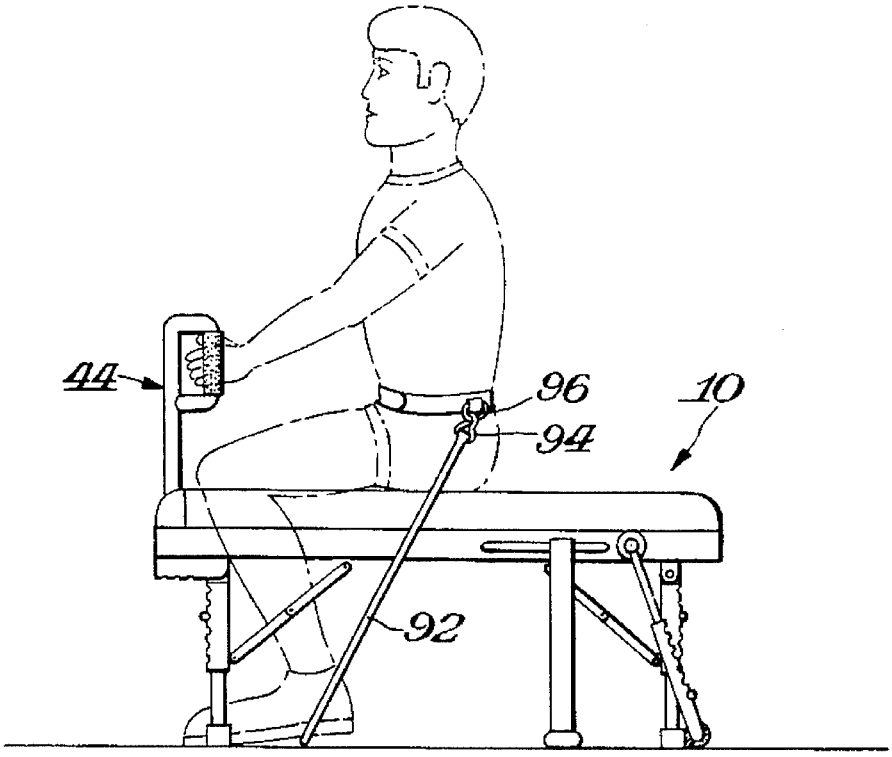

As previously described loops 42 are provided on the foot 40 which interconnects legs 22, 22. Similar loops may also be provided on the foot 40 which interconnects the legs 20, 20. Loops 42 function as convenient fastening members for elastic resistance cords 92. As shown in FIG. 5 resistance cords 92 include hooks 94 at their ends for snapping onto loops 42. It is to be understood that any other suitable means of fastening may be used for cords 92. In practice the elastic cords 92 could be hooked on the legs of the bench 10 by means of hooks 94 to provide resistance for various exercises or could be hooked on the bench itself such as by being secured to brackets 86 and would also loop around a portion of the user's body, such as the legs or waist to provide resistance. FIG. 7 illustrates a use of cords 92 where there is no physical attachment to the bench. Rather, the ends of the cords 92 have their hooks 94 secured to loops 96 on each side of the waist of the user with the cord 92 extending below the user's feet.

In the preferred practice of the invention bar 66 is mounted to be freely movable in an arc. If desired, however, bar 66 may include means at its pivot connection 69 for locking bar 66 at any angular orientation in connection with specific exercises where for example it might be desired to have the legs of the user upwardly inclined while the user lays on mat 14. Bar 66 may also be provided with spaced fasteners for having cords 92 connected thereto.

Handles 44 may also be modified to permit the distance between the handles to be adjusted. This could be done by mounting each handle so that it may swing or pivot in a horizontal plane in any suitable manner to move the handles 44 closer together or further apart.

The use of bench 10 as being adaptable for performing various exercises should be apparent from a description of the bench which includes padded support members with the handles, strap, bars and cords. The following, however, is a description of specific exercises intended to develop the muscles of the lower back, abdomen, and buttocks.

Bench 10 may be used for hyperextensions. In such use the user would lie face down on the top of mat 14 with the torso hanging off of one end. The adjustable strap 80 would wrap over the user's legs to secure and balance the weight of the upper body which is unsupported. The user then lets the torso bend downward and then slowly lifts the torso in a backward and upward direction to strengthen the muscles of the lower back.

Device 10 may also be used for traction/stretching exercises. In such use the legs of the bench would be adjusted to form a slant board. This could be done by lowering the rear legs 22, 22 or by completely folding the rear legs against the underside of support member 12 as illustrated in FIG. 5. In such condition of device 10 the user bends the mid section over the high end of the slant board so that the upper body hangs face down on top of bench 10 with the head of the user near the floor. The thighs are secured by the belt 80 around the legs of the bench. The torso/back can then hang in a partially upside down manner to create back traction and permit the back to be stretched.

Bench 10 is particularly adapted to permit five important abdominal exercises, namely, crunches, slant board sit-ups, sit-ups off the end, straight/bent leg lifts and bent leg curls.

In the user of bench 10 for crunches the user would place the pad or mat 14 on the floor and lie on his/her back with the back of his/her lower legs resting on the bench 10 so that the knees approximate a right angle. The user then lifts his/her shoulders upward/forward to exercise the muscles of the mid section.

For slant board sit-ups the user lies on the back facing up with the feet at the top secured by the strap 80. The user then lifts his/her torso upwards and then back down to strengthen the abdominals. This is done while the bench 10 is in an inclined condition as previously described.

Figure 8:
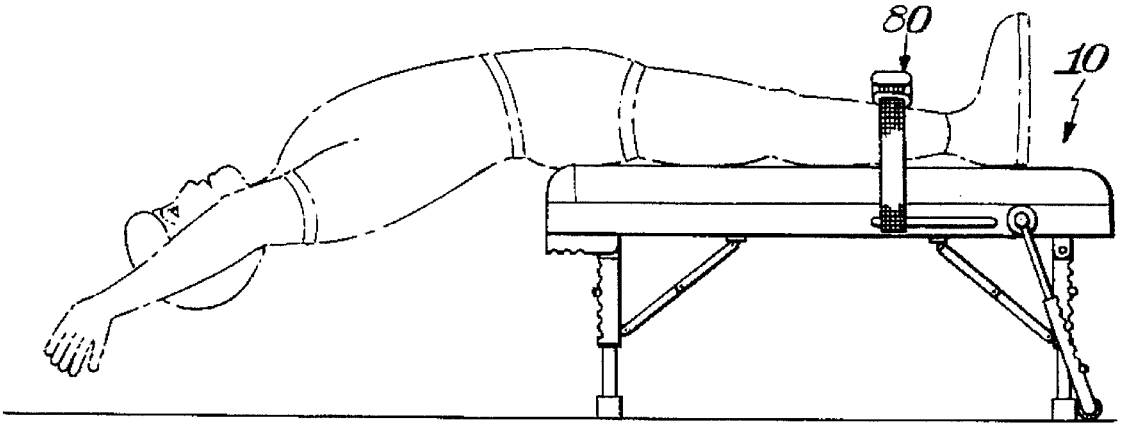

Bench 10 would be used for sit ups off the ends with the user lying on his/her back at one end of the bench 10 with the upper body hanging off the end as illustrated in FIG. 8. The legs are secured by the strap 80. The user bends backwards and then curls his/her torso upward until sitting in an upright position. This is repeated to strengthen the abdominals.

Bench 10 could be used for straight/bent leg lifts by the user lying on his/her back with the legs hanging off one side of the bench 10. The arms are bent backward over the user's head and the user grasps handles 44, 44 on each side of the bench 10. This balances the user's weight and keeps the user from rocking. The user then lifts his/her legs upwards to a right angle and then lets them drop down. This is repeated to strengthen the abdominal muscles.

When bench 10 is used for bent leg curls the user lies on his/her back and grabs the handles 44 overhead to balance his/her body. The user's legs lie on top of the padded bar 66 off one end and are secured to the bar 66 by the adjustable strap 80. The elastic cords 92 are anchored to the legs 22, 22 of the bench and attached to the center or ends of the padded bar 66. The legs/thighs are then lifted/curled upward against resistance as the padded bar rotates upward to exercise the abdominals.

Bench 10 may also be used for exercising the buttocks muscles in bench aerobics or squats/knee bends or leg curls with resistance. For bench aerobics support member 12 is used as an adjustable height platform. By stepping up and down and on and off the bench the user can get one of the best buttock exercises.

When bench 10 is used for squat/knee bends the user can straddle the bench facing one end and do squats or knee bends. The handles 44 can be positioned in a vertical attitude so that the handles can be grasped for balance when squatting. This is shown in FIG. 7. As also shown therein added resistance could be encountered by the use of cords 92. The squats and knee bends could also be performed facing the bench at one end without straddling it.

In performing leg curls with resistance on bench 10 the user lies face down on the bench and holds onto the handles 44. The pad 14 can be rolled up partially to act as a stomach pillow and to arch the back for comfort. The padded bar 66 is then extended so that the back of the achilles/ankle area is underneath. Resistance is placed on the bar by attaching the elastic cords to the bar and to the bench legs. Alternatively, the bar 66 can be fixed in an outward position and the elastic cords 92 can run over the bar 66 and be attached to the ankles. The user then curls his/her upper legs upward to exercise the buttock and hamstring muscles.

Bench 10 thus provides a multifunction exercise and aerobic bench which allows the user to perform various exercises to develop the three most difficult areas of the body to develop as well as other areas. As described bench 10 can be converted to a slant or incline board by having the legs at one end lowered or folded under. In addition, bench 10 can be adjustable in height to facilitate various exercises including step aerobics. The adjustability, foldability and removability of the various components of bench 10 are such that support member 12 and the other components can be rendered in a flat condition for ease of carrying or storage.

What is claimed is:

1. A multifunction exercise and aerobic bench comprising an elongated support member of a length to support a substantial portion of a user's body, said support member having a first end and a second end for supporting a user, at least one leg at each of said first end and said second end extending below said support member for elevating said support member, a handle assembly including two spaced handles each of which is disposed at opposite sides of said support member, said handle assembly being secured to said support member at said first end, said handles being selectively movable from a position directly above said support member to a position outwardly of said support member, said at least one leg at said second end being movably mounted to selectively dispose said second end at a lower elevation than said first end to selectively incline said support member, a belt mounted to said support member near said second end but inwardly thereof, a bar at said second end of said support member, said bar being spaced from and parallel to said second end of said support member, said bar having a length of generally the same dimension as the width of said second end of said support member, a leg assembly connected to said bar, said leg assembly having a first end and a second end, said first end of said leg assembly being rigidly connected to said bar, said second end of said leg assembly being pivotally connected to said support member to permit said bar to rotate over an arc from below said support member to above said support member, each of said handles including a vertical member having a hand gripping portion to permit the User to grid said handles with the user's hands while simultaneously engaging said bar with the user's legs to facilitate the pivoting of said bar by a leg lifting action while the user's body is maintained on said support member by the gripping of said handles, and each of said handles being selectively movable to a use position when said vertical member extends above said support member and to a non-use position to facilitate the storage of said bench during periods of non-use.

2. The bench of claim 1 including elastic cords for removable attachment to said bench.

3. The bench of claim 1 wherein said leg assembly comprises two bar connecting legs, each of said bar connecting legs having a first end and a second end, and said bar being connected to each of said first ends to form a U-shaped unit.

4. The bench of claim 3 wherein said end of said bar is adjustable in length and is padded.

5. The bench of claim 4 wherein each of said handles is located at the sides of said first end of said support member opposite each other.

6. The bench of claim 5 wherein said handles are detachably and adjustably mounted to said support member.

7. The bench of claim 6 wherein said vertical member of each of said hundles is adjustable in length, each of said handles further including a horizontal member which is adjustably mounted to said support member, said handles being detachably mounted to said support member, and each of said handles including a padded loop connected to said vertical member.

8. The bench of claim 7 wherein said at least one leg comprises a set of two legs at each of said first end and said second end, and each of said legs being pivotally connected to said support member.

9. The bench of claim 8 wherein each of said legs in its said set is connected to each other by a foot member secured across said set of legs, and said foot member at said second end having attachment loops.

10. The bench of claim 9 including elastic cords for detachable securement to said loops.

11. The bench of claim 10 including a padded mat mounted on and covering said support member.

12. The bench of claim 11 wherein said mat is removable from said support member.

13. The bench of claim 1 including a carry handle secured to said support member.

14. The bench of claim 1 wherein each of said handles is located at opposite sides of said first end.

15. The bench of claim 14 wherein said handles are detachably and adjustably mounted to said support member.

16. The bench of claim 15 wherein said vertical member of each of said handles is adjustable in length, each of said handles further including a horizontal member which is adjustably mounted to said support member, said handles being detachably mounted to said support member and each of said handles including a padded loop connected to said vertical member.

17. The bench of claim 1 wherein said at least one leg comprises a set of two legs at each of said head end and said foot end, and each of said legs being pivotally connected to said support member.

18. The bench of claim 17 wherein each of said legs in its said set is connected to each other by a foot member secured across said set of legs, and said foot member at said second end having attachment loops.

19. The bench of claim 18 including elastic cords for detachable securement to said loops.

* * * * *